United States Patent [19]

Chambley et al.

[11] 4,173,115

[45] * Nov. 6, 1979

[54] YARN FORMING APPARATUS WITH NODE WELDING

[75] Inventors: Phillip W. Chambley; Alan H. Norris, both of Rome, Ga.

[73] Assignee: WWG Industries, Inc., Rome, Ga.

[ * ] Notice: The portion of the term of this patent subsequent to Feb. 21, 1995, has been disclaimed.

[21] Appl. No.: 875,423

[22] Filed: Feb. 6, 1978

Related U.S. Application Data

[63] Continuation-in-part of Ser. No. 755,671, Dec. 30, 1976, Pat. No. 4,074,511.

[51] Int. Cl.[2] ..... H01B 13/04; D02G 3/26

[52] U.S. Cl. ..... 57/293; 156/73.2; 156/580.2

[58] Field of Search ..... 57/34 R, 34 AT, 22, 57/293; 156/73.2, 580.1, 580.2

[56] References Cited

U.S. PATENT DOCUMENTS

| | | | |
|---|---|---|---|
| 3,184,354 | 5/1965 | Strother | 156/73.2 |
| 3,434,275 | 3/1969 | Backer et al. | 57/34 AT |
| 3,775,955 | 12/1973 | Shah | 57/34 AT |
| 4,074,511 | 2/1978 | Chambley et al. | 57/34 AT |

*Primary Examiner*—Charles Gorenstein

*Attorney, Agent, or Firm*—Beveridge, DeGrandi, Kline & Lunsford

[57] ABSTRACT

False-twisted yarn strands are separately carried around a guide wheel and the nodes thereof are brought together and locked by applying heat to the nodes and pressing them together, after which the strands are self-twisted. Embodiments include a cam actuated clamping device which holds the yarns in an ultrasonic transducer to which energy is supplied to accomplish the welding. Devices using resistance heating and laser impulses are also disclosed.

8 Claims, 11 Drawing Figures

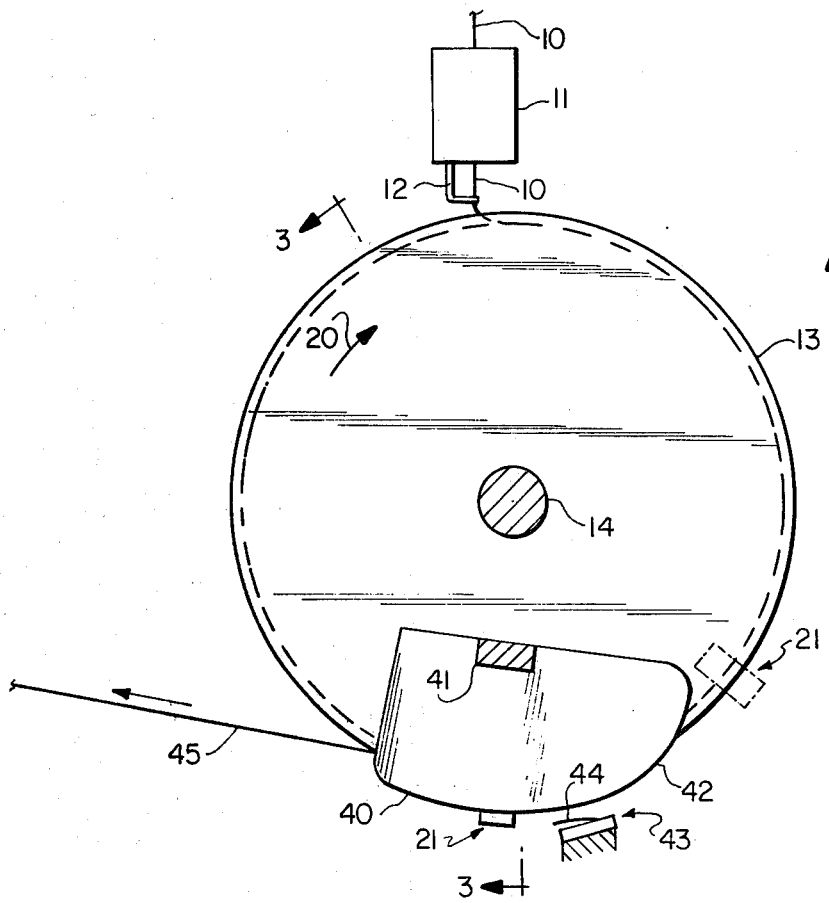
FIG. 1
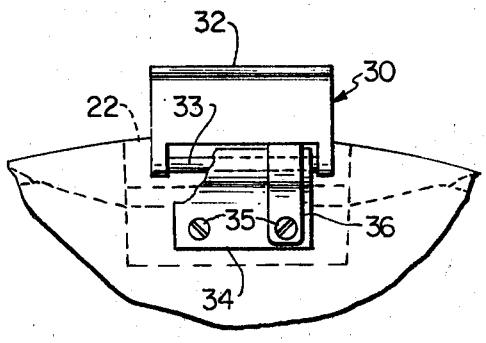
FIG. 2
FIG. 3
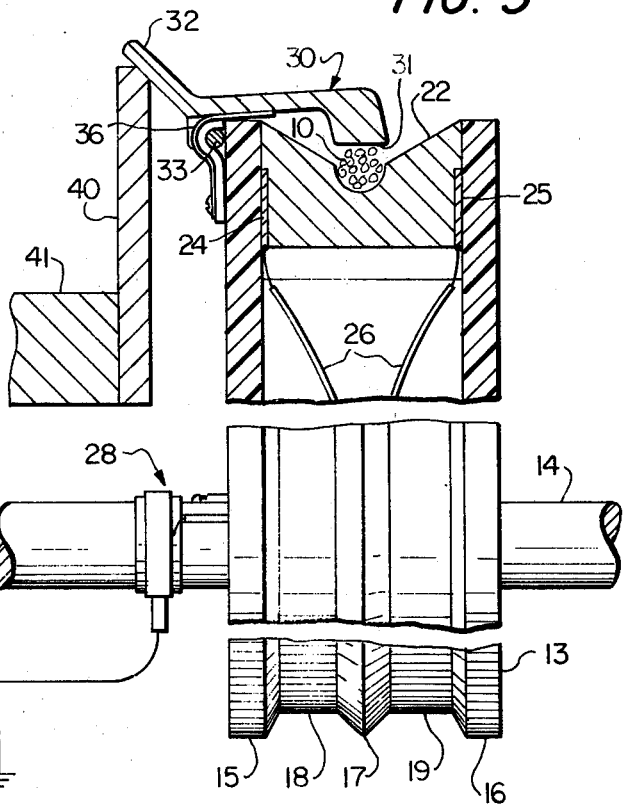

YARN FORMING APPARATUS WITH NODE WELDING

This is a continuation-in-part of our earlier application Ser. No. 755,671, filed Dec. 30, 1976 now U.S. Pat. No. 4,074,511.

This invention relates to apparatus for joining multiple yarn strands and, more specifically, to apparatus for welding together the nodes of self-twisted yarn strands.

BACKGROUND OF THE INVENTION

In our U.S. Pat. No. 4,074,511 which is incorporated herein by reference, there is disclosed a system for forming self-twist, false-twist yarn strands. It was pointed out therein that it is highly desirable to join false-twisted yarn strands at their nodes before permitting the strands to ply together because the resulting product is more stable and its characteristics are more reliably predictable.

To accomplish that goal, the system provided a rotatable guide member in the form of a yarn wheel having circularly extending guide flanges defining guide paths therebetween. At least three such flanges are provided to define separated guide paths for at least two yarns, although multiple flanges can be used for multiple yarns, the number of flanges always being one more than the number of yarns.

The inner separatory flange or flanges are interrupted at at least one location to permit the guide paths to merge so that the yarn strands therein can be brought together and joined or locked together. The joined strands then leave the yarn wheel and are permitted to self-twist, forming a plied yarn.

The locking means disclosed in that application comprises a rotating disc, the surface of which is exposed to the strands at the interruption location. The disc rotates at a relatively high speed, engaging and entangling the fibers of the yarn strands to accomplish the locking. The disc is driven by a motor carried in the rotating yard wheel. Two or more motor and disc arrangements can be provided and located such that the circumferentail distance between discs is equal to the spacing between nodes. It will be recognized that the yarn wheel rotation speed is synchronized with the longitudinal speed of the yarn so that there is substantially no longitudinal movement of the yarn relative to the guide surfaces on which they lie.

While this arrangement is quite suitable for spun yarns of carded staple fiber, its effect is somewhat reduced in the processing of bulked continuous filament yarns. This is due to the availability of many free ends of fibers to be intertwined in the spun yarn node, whereas the continuous filament yarn has no free fiber ends available for twisting together and locking the node.

There is consequently a need for other methods of node locking, that will operate on self twist yarns of either the spun staple or continuous filament variety.

BRIEF DESCRIPTION OF THE INVENTION

Accordingly, the present invention provides alternative and improved apparatus for joining yarn strands, particularly separately carried strands on a rotating guide member, by applying heat to weld fibers of the strands together.

Briefly described, the invention includes an improved apparatus for joining synthetic yarn strands in a machine of the type having means for forming at least two singles yarn strands, means for twisting each of the strands individually to form false-twisted strands, each having longitudinally spaced nodes at which the direction of twist reverses, rotatable guide means having a central axis for guiding and carrying said strands into spaced substantially parallel paths with the nodes of the strands substantially aligned with each other, means at a predetermined location on said guide means for bringing the nodes of the strands into contact with each other, and means for joining the strands to each other at the nodes, the improvement wherein the means for joining comprises heating means for elevating the temperature of the yarn strand nodes to a temperature substantially at the softening point thereof whereby said nodes are welded to each other.

In order that the manner in which the various objects are attained in accordance with the invention can be understood in detail, particularly advantageous embodiments thereof will be described with reference to the accompanying drawings, which form a part of this specification, and wherein:

FIG. 1 is a side elevation of a yarn guide wheel showing the general arrangement of a joining device in accordance with the present invention;

FIG. 2 is an enlarged partial side elevation of a clamping apparatus in accordance with the device of FIG. 1;

FIG. 3 is an enlarged and inverted front elevation, in partial section, of the apparatus of FIGS. 1 and 2;

Figure 4:
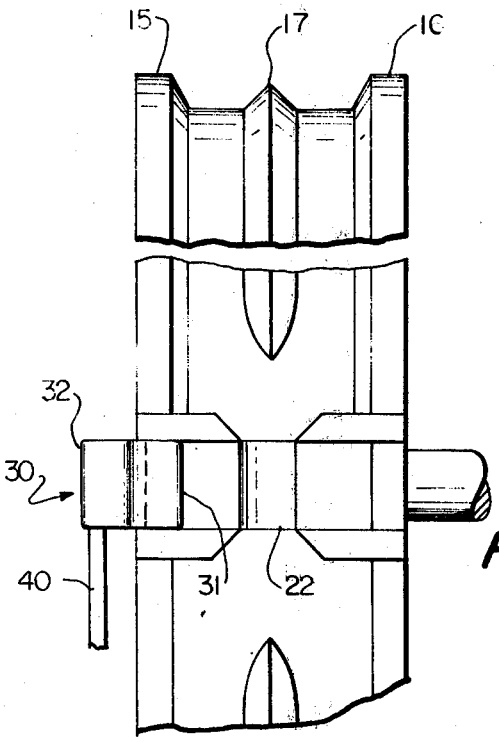
FIG. 4 is a plan view of the apparatus of FIG. 3.

Referring first to FIG. 1, it will be seen that a plurality of yarn strands 10, only one of which is visible in FIG. 1, are delivered to a plurality of false-twisting jet devices 11, wherein each yarn strand is false-twisted. The strands 10 are then delivered through a conventional wire guide device 12 to a yarn guide wheel 13. The basic structure of the twist jets and yarn wheel, as thus far described, are fully disclosed in previously mentioned U.S. Patent Application Ser. No. 755,671, now U.S. Pat. No. 4,074,511, and will not be described in detail herein. However, it will be helpful to note that the yarn wheel is mounted on a shaft 14 for rotation therewith and is driven at a speed synchronized with the movement of the yarn so that there is little or no relative movement between the yarn and the wheel as the yarn passes around the surface thereof.

The general configuration of the guide surfaces of the yarn wheel are shown in the bottom portion of FIG. 3 wherein it will be seen that the wheel has side flanges 15 and 16 and a central separatory flange 17, these three flanges defining two guide surface areas 18 and 19 onto which yarn is delivered. While it is entirely possible, as indicated in the previously mentioned application, to provide a somewhat larger number of separatory flanges and, therefore, a larger number of guide surfaces to handle a like number of yarns, the present invention will be described in the context of a system designed to accommodate and join together the nodes of only two such yarns.

Returning again to FIG. 1, it will be observed that the yarn 10 is supplied onto the guide surfaces of wheel 13 which is rotating in the direction indicated by arrow 20, thereby causing the yarns to be laid upon the surface of the guide wheel and to pass around approximately one-half of the circumference of the wheel.

In accordance with the present invention, the yarn wheel is provided with an ultrasonic joining device and clamping means indicated generally at 21, the structure thereof being more clearly shown in FIG. 2 and 3. The joining device includes an ultrasonic transducer 22 which is formed, as shown in FIG. 3, with a central groove and inclined surfaces extending inwardly and downwardly toward the groove from the peripheral surfaces of flanges 15 and 16. The angular extent of the transducer is at least as long as the node region, and can be selected to accommodate the node length of the yarn which is to be joined. As seen in FIG. 2, the portions of the guide surfaces 18 and 19 adjacent the transducer can be beveled so that the guide surfaces extend downwardly, or radially inwardly smoothly to the bottom portion of the groove in the transducer. It will be observed that separatory flange 17 is interrupted in the vicinity of the transducer to permit the yarns in guide surfaces 18 and 19 to be brought together and placed in the transducer groove adjacent each other.

The transducer 22 is preferably a piezoelectric structure and is supplied with electrical energy through conductive elements 24 and 25 affixed thereto, the conductive elements being connected to wires 26 which are connected to a power source 27 of a conventional type designed to provide energy at ultrasonic frequencies. Conductors 26 can be caused to reach the power source through a slip ring assembly indicated generally at 28 which is of conventional design.

In order to press the yarns firmly together and in intimate contact with the groove in transducer 22, there is provided a clamp structure having a clamp member 30 which has a surface 31 designed to press against the yarns. At the opposite end of the clamp structure from surface 31 is a cam arm 32 which protrudes beyond the surface of wheel 13, the clamp structure having downwardly extending ears connected to a pivot pin 33 which is received in a sheet metal attachment device 34 attached to the outer surface of wheel 13 as by screws 35. The attachment device 34 is a relatively simple fastener having a U-shaped bend at one end thereof to receive the pivot pin 33 relatively loosely so that the entire clamping structure can pivot about the central axis thereof. A spring 36 which is a leaf spring of highly resilient material is fastened under one of screws 35 and extends upwardly and around the U-shaped end portion of attachment device 34 and extends between the outer surface of flange 15 and the inner surface of the pivoting clamping member 30. The purpose of spring 36 is to urge the entire clamping member counterclockwise, thereby tending to move the clamping surface 31 away from the yarns contained in the transducer groove. Thus, unless forced into the clamping position, surface 31 lies in essentially the same plane as flange 15 and is therefore out of the way of yarns being placed around the guide surfaces and in the transducer groove. In order to move the clamp into the operating position shown in FIG. 3, a cam plate 40 is mounted adjacent the side surface of wheel 15 on a mounting block 41, the cam plate having a surface 42 which is smoothly curved so as to come in contact with cam arm 32, elevating that cam arm as the wheel rotates in the direction of arrow 20, thereby forcing surface 31 onto the yarns in the transducer groove. It will be noted that plate 40 does not rotate with wheel 13. Thus, clamp member 30 is moved to the clamping position once during each revolution of the wheel and remains in that position for about 40° of wheel rotation. A switch 43 is fixedly mounted near plate 40 at approximately the position at which surface 31 is caused to clamp the yarns in position, the switch having an actuating member 44 which is moved by cam arm 32 of the clamping member as it passes along the outer surface of plate 40. As seen in FIG. 3, swtich 43 is a normally open switch which is connected to the power source 27 and is arranged to energize source 27, permitting it to supply power to transducer 22. Preferably, source 27 includes a time-controlled circuit, such as a monostable multivibrator, so that it will supply ultrasonic energy to the transducer for an interval of time approximately equal to the elapsed time of travel of wheel 13 through the 40° of wheel rotation during which the yarn is clamped in the transducer. Alternatively, a second switch mounted adjacent the path of travel of the cam structure can be connected to the power source to deactivate it after the node joining has been accomplished.

At the clockwise end of the cam surface of plate 40, the clamping device is released and permitted to rotate counterclockwise, as viewed in FIG. 3, so that surface 31 thereof is moved away from the yarn, permitting the joined yarn 45 to be guided away from the wheel and stored or further processed.

It will be recognized that if the yarn is to be produced with nodes closer together than one circumference of wheel 13, additional clamping devices and transducers can be provided on the wheel, each such device being activated by cam plate 40 and switch 43 as the yarn reaches the joining point.

Figure 5:
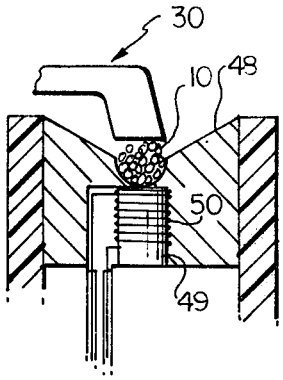
FIG. 5 is a partial front elevation, in partial section, of a further embodiment of an apparatus in accordance with the invention.

A further embodiment in accordance with the invention is illustrated in FIG. 5, the major portion of the structure being substantially identical to that shown in FIG. 1–4, the difference being that a magnetostrictive transducer is used in place of a piezoelectric transducer. The clamping device 30 is constructed and operated as shown in FIGS. 1–4, as is the yarn wheel itself. However, in place of the ultrasonic transducer there is provided a body 48 of material coupled to a magnetostrictive cylinder 49 which is surrounded by an energizing winding 50, winding 50 being connected to ultrasonic power source 27 as through the slip ring structure previously mentioned. In either of the embodiments shown in FIGS. 1–5, the rapid physical vibration of the piezoelectric or magnetostrictive transducers induced by application thereto of the ultrasonic alternating current produced by source 27 causes friction between the transducer and the individual fibers of the yarns 10, and between the fibers themselves, thereby generating frictional heat causing a bond to form between the fibers.

Figure 6:
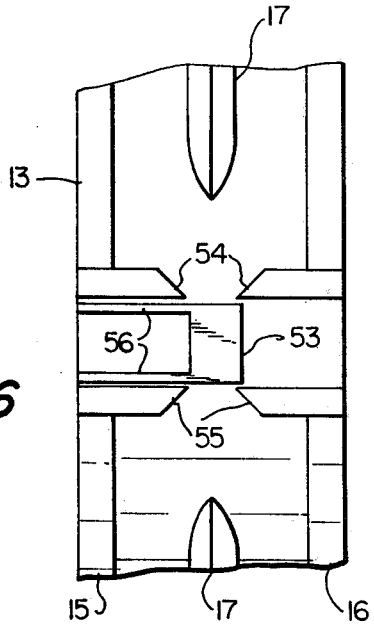
FIG. 6 is a plan view of yet another embodiment of an apparatus in accordance with the invention.
Figure 7:
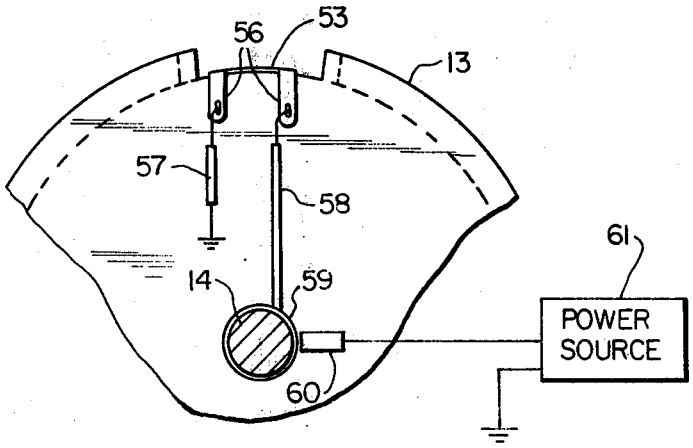
FIG. 7 is a side elevation of the apparatus of FIG. 6.

A further embodiment of the invention is shown in FIGS. 6 and 7 wherein a heating plate is employed to weld the fibers of the yarns together. As shown in the figures, the wheel with flanges 15, 16 and 17 is structurally similar to that discussed in connection with FIGS. 1–5. At the joining point, and electrically conductive heating element plate 53 is mounted in that portion of the guide surface where flange 17 is interrupted, the wheel having beveled pairs of guide member 54 and 55 to cause the yarns to be pressed into engagement with each other as they pass over element 53. Electrically conductive strips 56 extend transversely from element 53 and downwardly over the side surface of the wheel where they are connected to wires 57 and 58, one of which is grounded and the other of which is connected to a slip ring 59 on which a brush 60 rides. Brush 60 is connected to a source of electrical power 61 which can be either a DC or an AC source, the magnitude of current supplied by source 61 being determined by the nature of the material chosen for plate 53 and its resistivity. The heating element is selected, in conjunction with the current source, so that its temperature is above the softening point of the synthetic fibers used for the yarns to be joined thereby. As in the case of the ultrasonic welding embodiments, the current can be supplied during some predetermined interval of angular travel of the wheel by a switch actuated by some moving portion of the wheel. Alternatively, the power can be continuously supplied to the heating plate at a lower temperature, thereby permitting a longer interval of exposure of the yarns to the plate to accomplish the welding together thereof as a result of the heating and softening.

Figure 8:
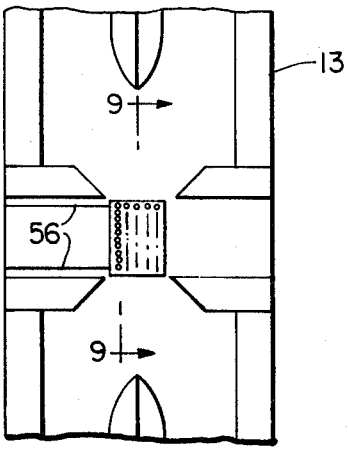
FIG. 8 is a plan view of a still further embodiment of an apparatus in accordance with the invention.
Figure 9:
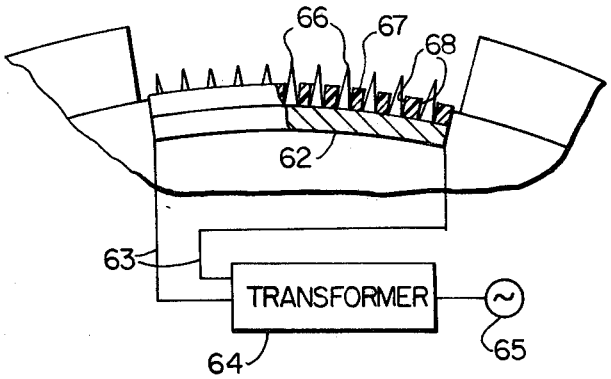
FIG. 9 is a partial sectional view along lines 9—9 of FIG. 8.

A further embodiment of a heating element form of welding device is shown in FIGS. 8 and 9, the wheel 13 and conductive strips 56 being as described with reference to FIGS. 6 and 7. As best seen in FIG. 9, the heating element of this embodiment of this invention includes an electrically conductive heating element plate 62 which is mounted in a recess below the guide surface of the yarn wheel, plate 62 being connected by strips and conductors 63 to a source which can include a transformer 64, in the nature of a soldering iron type of transformer, which is connected to a source 65 of alternating current. Protruding from the radial outward surface of plate 62 is a plurality of needle-like pointed projections 66, arranged in rows and columns in a generally rectangular array. A layer of electrically nonconductive material 67 overlies the outer surface of plate 62 and is provided with a plurality of openings 68 through which projections 66 extend. As will be recognized, the projections are significantly longer than the thickness of insulating plate 67 so that the yarns, as they are placed on the guide surface and caused to lie across the joining point, are penetrated by the projections.

Heat generated by the passage of current through plate 62 is conducted into the projections and, thereby, into the fibers of the yarns to be joined, causing the fibers to soften and to weld to each other. The advantage of the embodiment of FIGS. 8 and 9 is that the area of contact of the yarns is less than with the heater element of the embodiment of FIGS. 6 and 7, thereby reducing the possibility of undesirable sticking of the yarns to the element, but the heat is conducted to the interior of the yarns by projections 66 more effectively than with the heating plate. Thus, more efficient fusing results, and there is less possibility of weakening of the node area. It will be observed that projections 66 can take various forms, and can advantageously be similar to needle points rather than the conical projections illustrated.

Figure 10:
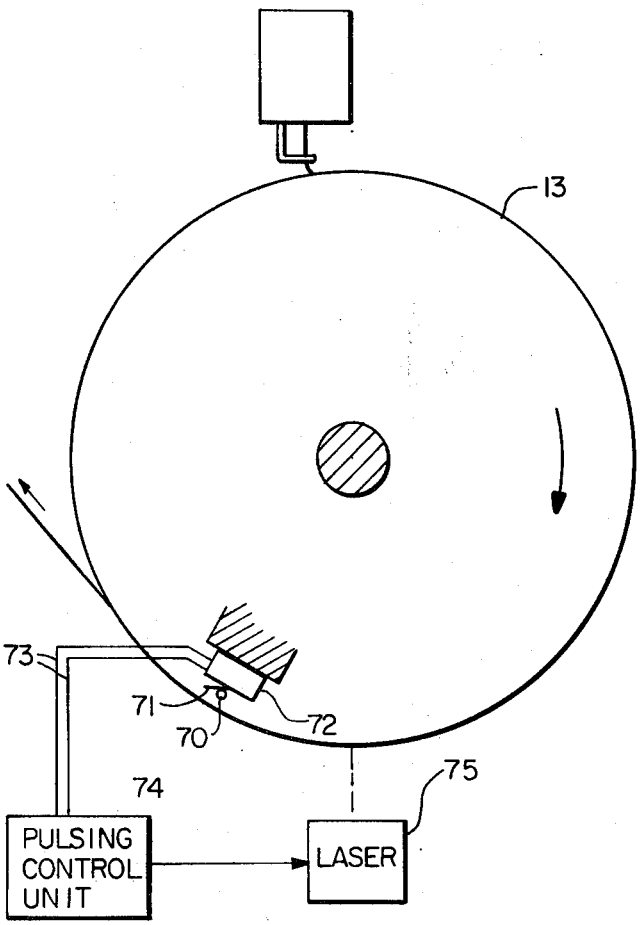
FIG. 10 is a side elevation of yet another embodiment of an apparatus in accordance with the invention.
Figure 11:
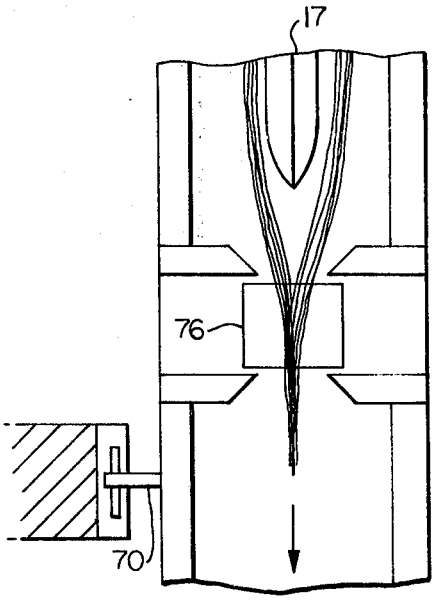
FIG. 11 is a plan view of a portion of the apparatus of FIG. 10.

Yet another embodiment of an apparatus for joining yarns is shown in FIGS. 10 and 11 wherein the overall construction of wheel 13 is similar to that previously discussed. A timing pin 70 protrudes from one outer surface of wheel 13 in a position to contact the actuator 71 of a normally open switch 72 fixedly mounted adjacent the path of travel of the wheel. Switch 72 is connected by conductors 73 to a pulsing control unit 74 which activates a laser transmitter 75, the output beam of which is focused on the guide surface of wheel 13 in a plane occupied by separatory flange 17. As shown in FIG. 11, at the desired joining point, a flat plate 76 is mounted in the location occupied by the heating elements of FIGS. 6–9, plate 76 being unaffected by the laser beam. If desired, the surface thereof can be reflective. The laser is of a conventional pulse type and is actuated by the contact of pin 70 with the actuator of switch 72 so that when the plate 76 reaches the point at which the beam will strike, the laser is pulsed by control unit 74 to cause the laser beam to elevate the temperature of the yarns at the node, thereby welding them together. It will be observed that the relative angular locations of pins 70 and plate 76 is critical so that the beam strikes the node at the desired joining point. The joined yarn is then removed from the yarn wheel, as before.

While certain advantageous embodiments have been chosen to illustrate the invention, it will be understood by those skilled in the art that various changes and modifications can be made therein without departing from the scope of the invention as defined in the appended claims.

What is claimed is:

1. An improved apparatus for joining synthetic yarn strands in a machine of the type having means for forming at least two singles yarn strands, means for twisting each of said strands individually to form false-twisted strands, each having longitudinally spaced nodes at which the direction of twist reverses, rotatable guide means having a central axis for guiding and carrying said strands into spaced substantially parallel paths with the nodes of said strands substantially aligned with each other, means at a predetermined location on said guide means for bringing the nodes of said strands into contact with each other, and means for joining said strands to each other at the nodes, the improvement wherein said means for joining comprises heating means for elevating the temperature of said yarn strand nodes to a temperature substantially at the softening point thereof whereby said nodes are welded to each other.

2. An apparatus according to claim 1 wherein said means on said rotatable guide means for bringing said strands into contact with each other includes guide surface means for pressing said strands together axially relative to the axis of rotation of said rotatable guide means and clamp means for pressing said strands together in a radial direction relative to said rotatable guide means, and wherein said heating means includes a transducer mounted in said rotatable guide means at said predetermined location for vibrating said strands against each other to generate frictional heat, and a source of oscillatory energy connected to said transducer.

3. An apparatus according to claim 2 wherein said transducer comprises a body of piezoelectric material having a groove therein shaped to receive said strands, and said source comprises circuit means for producing electrical signals at a predetermined frequency at which said body vibrates, and electrical conductors connecting said circuit means to said body.

4. An apparatus according to claim 3 wherein said clamp means includes a cover clamp, means for hingedly connecting said clamp to a peripheral portion of said rotatable guide means adjacent said predetermined location to permit said clamp to be moved between a clamping position in which said clamp lies across said paths and said body, and an open position in which said clamp is spaced from said body; and spring means for urging said clamp toward said open position;

and wherein said apparatus further comprises cam means mounted adjacent said rotatable guide means for periodically contacting said cover clamp and moving said clamp to said clamping position.

5. An apparatus according to claim 2 wherein said transducer comprises a magnetostrictive body, and a winding coupled to said body, said winding being connected to said source.

6. An apparatus according to claim 1 wherein said heating means comprises a heating element including a plate of electrically conductive material mounted in said guide means at said predetermined location with a surface thereof exposed to said nodes, and a source of electrical current connected to said heating element.

7. An apparatus according to claim 1 wherein said heating means includes a heating element including a plate of electrically conductive material mounted in said guide means and a plurality of needlelike projections protruding radially from said plate to contact and penetrate said nodes, a body of electrically nonconductive material overlying said plate, said body having a plurality of holes therein through which said projections extend; and a source of electrical energy connected to said plate.

8. An apparatus according to claim 1 wherein said heating means comprises a laser;

control circuit means for causing said laser to emit a pulse of energy;

support means for supporting said laser with the output thereof directed toward a target area on the guide path of said rotatable guide means;

switch means adjacent said guide means for energizing said control circuit means; and means on said guide means for operating said switch means to cause said laser to emit said pulse when said guide means is rotated to present said predetermined location at said target area.

* * * * *